US006835884B2

(12) United States Patent
Iwamoto et al.

(10) Patent No.: US 6,835,884 B2
(45) Date of Patent: Dec. 28, 2004

(54) SYSTEM, METHOD, AND STORAGE MEDIA STORING A COMPUTER PROGRAM FOR ASSISTING IN COMPOSING MUSIC WITH MUSICAL TEMPLATE DATA

(75) Inventors: Toshiyuki Iwamoto, Hamamatsu (JP); Shigehiko Mizuno, Hamamatsu (JP); Hiroyuki Masuda, Kawasaki (JP); Shuzo Karakawa, Hamamatsu (JP); Hiroaki Takahashi, Hamamatsu (JP)

(73) Assignee: Yamaha Corporation (JP)

( * ) Notice: Subject to any disclaimer, the term of this patent is extended or adjusted under 35 U.S.C. 154(b) by 55 days.

(21) Appl. No.: 09/956,233

(22) Filed: Sep. 19, 2001

(65) Prior Publication Data

US 2002/0033090 A1 Mar. 21, 2002

(30) Foreign Application Priority Data

Sep. 20, 2000 (JP) ..... 2000-285624

(51) Int. Cl.[7] ..... G10H 7/00; A63H 5/00; G04B 13/00

(52) U.S. Cl. ..... 84/609; 84/615

(58) Field of Search ..... 84/609, 615

(56) References Cited

U.S. PATENT DOCUMENTS 6,245,984 B1 6/2001 Aoki et al. ..... 84/611
6,423,893 B1 * 7/2002 Sung et al. ..... 84/645

FOREIGN PATENT DOCUMENTS

JP 2000-221976 8/2000

* cited by examiner

*Primary Examiner*—Jeffrey W Donels
(74) *Attorney, Agent, or Firm*—Rossi & Associates

(57) ABSTRACT

A server apparatus connected in a communication network provides a plurality of music piece template data files respectively representing features of source music pieces. A client apparatus connected in the communication network requests a music piece template data file from the server. The server delivers and the client receives the requested template data file. The client creates a new piece of music based on the received template data file. The created music piece is a new piece but resembles the source music piece to a certain extent having certain characteristic features of the source music. In an alternative arrangement, the server delivers a source music piece, and the template data file is created at the client side by extracting features from the source music piece.

15 Claims, 15 Drawing Sheets

*Fig. 7* Automatic Performance
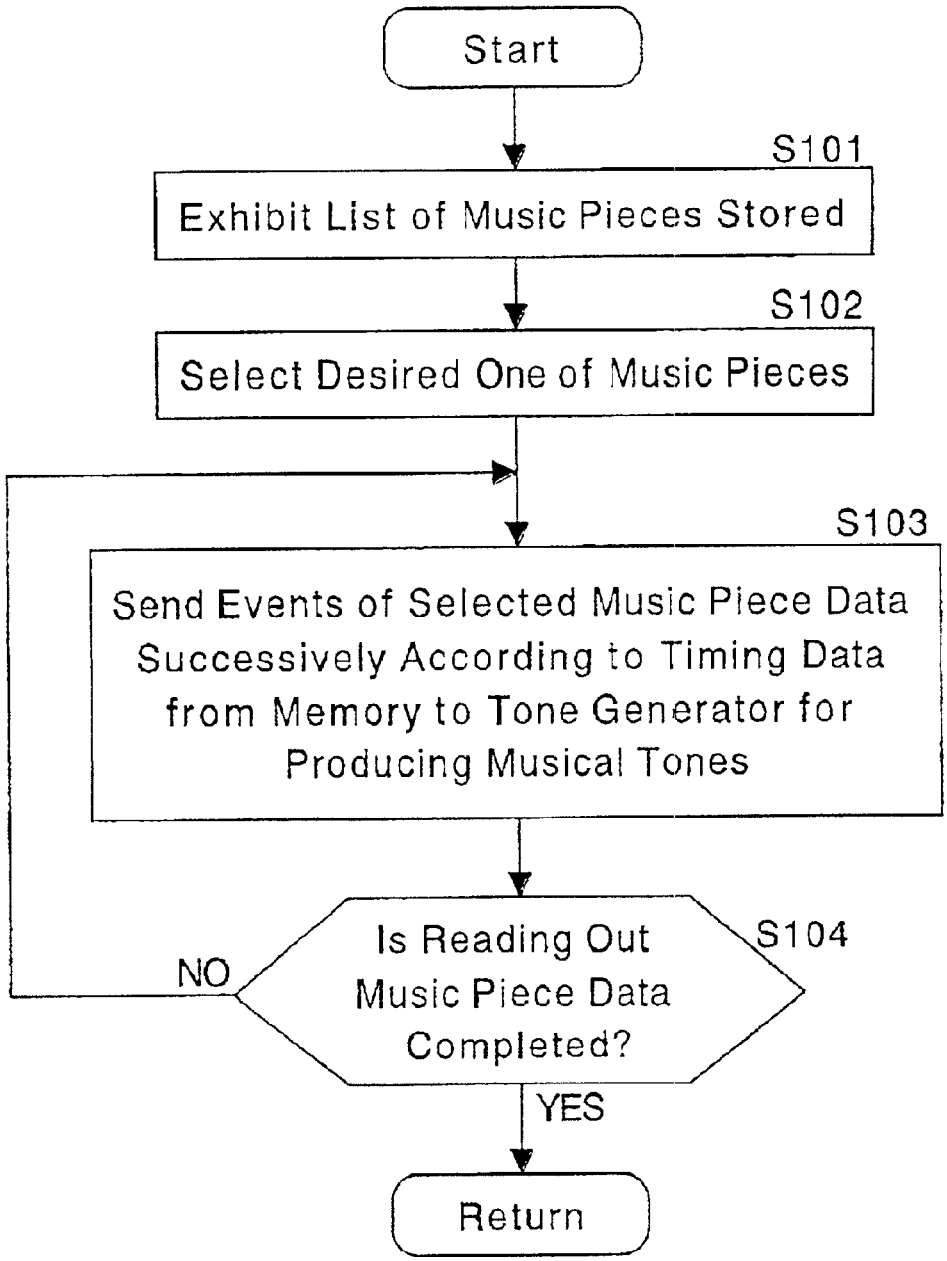

*Fig. 8a* Extraction of Elemental Data for Music Templates
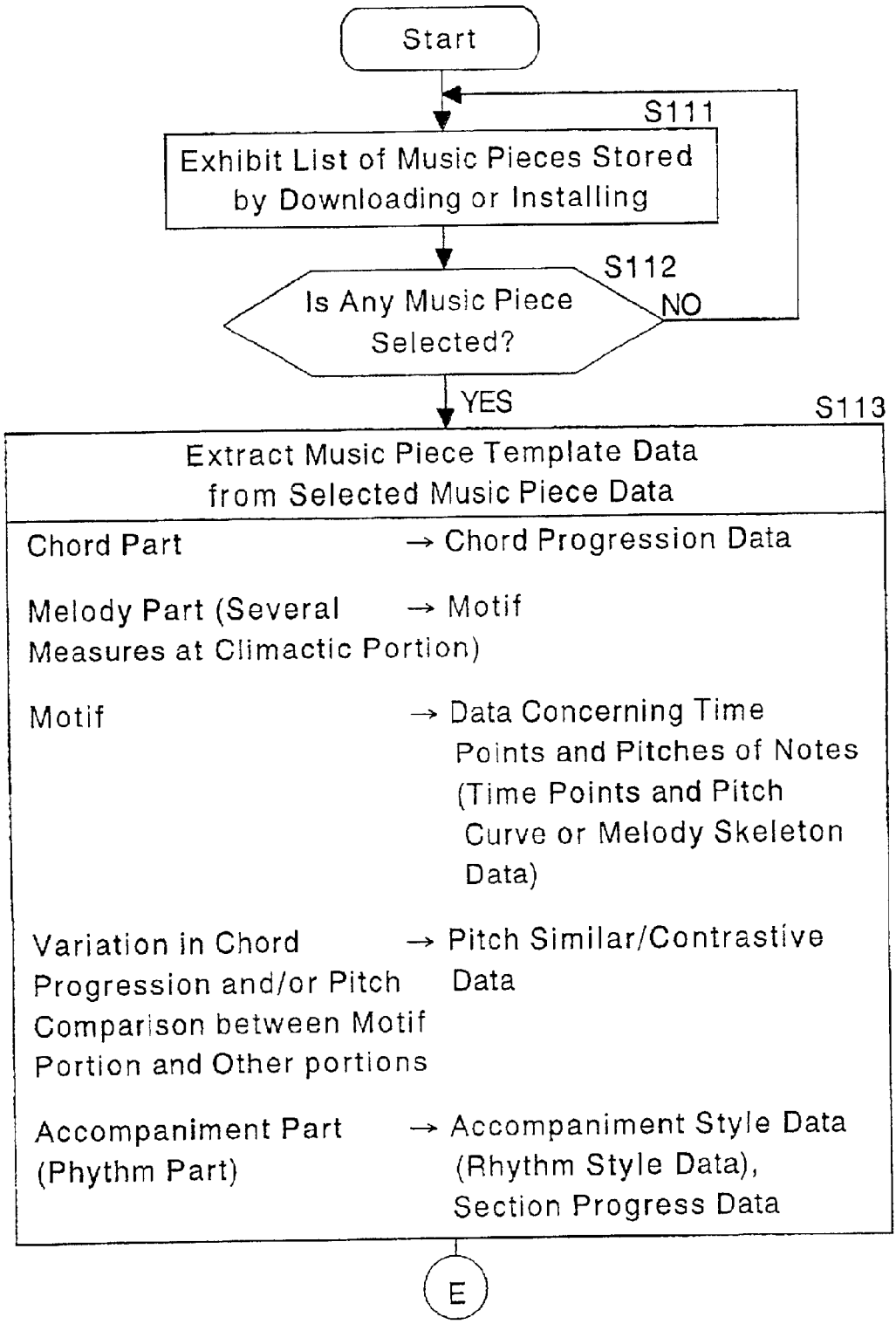

Creation of New Music Piece Data (2)

Creation of New Music Piece Data (3)

SYSTEM, METHOD, AND STORAGE MEDIA STORING A COMPUTER PROGRAM FOR ASSISTING IN COMPOSING MUSIC WITH MUSICAL TEMPLATE DATA

RELATED APPLICATION

This application claims priority from Japanese Patent Application No. 2000-285624, filed Sep. 20, 2000, the contents of which are incorporated hereinto by this reference.

BACKGROUND OF THE INVENTION

1. Field of the Invention

The present invention relates to a system and a method for assisting in composing music by means of musical templates extracted from existing pieces of music, and a machine readable medium containing program instructions for realizing such a system and a method, and more particularly to a system and a method for assisting a user in composing a music piece by selectively utilizing music piece templates representing various characteristic elements of existing music pieces. The present invention also relates to a musical template data providing apparatus for supplying music piece template data to clients via a communication network.

2. Description of the Prior Art

In accordance with the popularization of portable telephones (cellular phones), personal computers and other terminal units to be used in a communication network, and with the dramatic increase of accesses to Internet, data delivery services from a server on Internet are becoming more and more popular to deliver musical data to communication terminal units in a MIDI file format, a WAVE file format, MP3 (MPEG1 Audio Layer 3) compressed file format, and so forth. The user makes an access to a server computer from a communication terminal unit via a communication network to download desired music piece data from among data files of a plurality of music pieces stored in the server computer, and plays back the downloaded music piece data by the communication terminal unit or by an electronic musical instrument or the like connected to the communication terminal unit to enjoy listening to the played-back music or to utilize the music as the sound of telephone ringing. However, mere playback of existing music will be taken as being monotonous and non-original.

Also known in the art is a type of music data composing apparatus which is capable of forming music piece data through edition by the user to meet the user's preference, as described, for example, in Japanese unexamined patent publication No. 2000-221976 dated Aug. 11, 2000 and in its parallel U.S. Pat. No. 6,245,984 issued Jun. 12, 2001, in which a personal computer stores a plurality of basic musical template data sets beforehand as the software for the computer and the user selects the situation, the feeling, the style, etc. to determine the template to be used for edition, so that the user may compose a desirable music piece according to the user's intention. The musical template data therein are basic information for constituting music pieces and contain chord progression data, melody skeleton data, accompaniment style data, and so forth, and will be originally prepared by a software maker. Such a scheme will allow the user to create an original work of music data easily independently from existing music pieces.

As the musical template data are usually installed together with a software program from a CD-ROM or downloaded with a software program via a communication network, there is a limit in variety. Accordingly, with a conventional music piece data creating apparatus, music piece data will be created from one of a limited number of musical templates, and hence a created music piece will be short of climax (bridge) and characteristics as compared with the existing music piece data, even though the user adds some edition thereto.

SUMMARY OF THE INVENTION

It is, therefore, an object of the present invention to solve the prior art disadvantages and to provide a system and method for assisting a user in composing music piece data which will contain characteristics derived from existing original music pieces, and also to provide a music piece template data providing apparatus for supplying music piece template data to clients via a communication network for assisting in composing music piece data.

According to the present invention, the object is accomplished by providing a system for assisting in composing music comprising: a communication network, a server apparatus which is connected in the communication network and provides music piece template data files respectively representing features of source music pieces, and a client apparatus which is connected in the communication network and creates a music piece data file based on music piece template data; wherein the server apparatus includes: a music piece template data storing device which stores a plurality of music piece template data files respectively representing features of source music pieces; and a data supplying device which supplies, via the communication network, a music piece template data file as selectively requested by the client apparatus out of the stored plurality of music piece template data files; and the client apparatus includes: a data receiving device which selectively requests, via the communication network, a desired music piece template data file from the server apparatus, and receives, via the communication network, the desired music piece template data file from the server apparatus; a music piece data creating device which creates data of a new piece of music based on the received music piece template data file; and a storing device which stores the data of a new piece of music.

According to an aspect of the present invention, the server may deliver a source music piece, and the template data file may be created at the client side by extracting features from the source music piece.

According to the present invention, the object is further accomplished by providing an apparatus for assisting in composing music comprising: a data receiving device which is to receive selectively a desired music piece template data file from a music piece template data providing apparatus which stores a plurality of music piece template data files respectively representing features of source music pieces; a connecting device which connects the data receiving device to the music piece template data providing apparatus for delivering the desired music piece template data file; a music piece data creating device which creates data of a new piece of music based on the received music piece template data file; and a storing device which stores the data of a new piece of music.

According to another aspect of the present invention, the music piece template data providing apparatus is a server apparatus connected in a communication network and delivers the desired music piece template data file to the data receiving device upon request of delivery from the data receiving device which is also connected in the communication network through the connecting device.

According to a further aspect of the present invention, the music piece template data files are prepared by extracting features of source music pieces.

According to a still further aspect of the present invention, the music piece template data files contain chord progression data for several measures of music, data concerning pitches and time points of notes for several measures of music, and/or accompaniment style data.

According to a still further aspect of the present invention, the music piece template data providing apparatus stores the plurality of music piece template data files together with the corresponding source music piece data files for delivering the desired music piece template data file together with the corresponding source music piece data file.

According to a still further aspect of the present invention, the apparatus for assisting in composing music further comprises a performance playback device which reads out from the storing device the data of the created new piece of music to play back the new piece of music.

According to a still further aspect of the present invention, the apparatus for assisting in composing music further comprises a data sending device for sending the music piece template data file and/or the data of the created new piece of music together with an electronic mail to another apparatus via the communication network.

According to the present invention, the object is further accomplished by providing an apparatus for assisting in composing music comprising: a data receiving device which is to receive selectively a desired music piece data file from a music piece data providing apparatus which stores a plurality of music piece data files respectively representing source music pieces; a connecting device which connects the data receiving device to the music piece data providing apparatus for delivering the desired music piece data file; a music piece template data creating device which creates a music piece template data file corresponding to the received music piece data file by extracting features of the source music piece from the received music piece data file; a music piece data creating device which creates data of a new piece of music based on the created music piece template data file; and a storing device which stores the created music piece template data file, or the created music piece template data file and the data of a new piece of music.

According to a still further aspect of the present invention, the music piece data providing apparatus is a server apparatus connected in a communication network and delivers the desired music piece data file to the data receiving device upon request of delivery from the data receiving device which is also connected in the communication network through the connecting device.

According to the present invention, the object is further accomplished by providing a music piece template data providing apparatus comprising: a music piece template data storing device which stores a plurality of music piece template data files respectively representing features of source music pieces; a data supplying device which supplies a music piece template data file as selectively requested by a user terminal out of the stored plurality of music piece template data files; and a connecting device which connects the data supplying device to the user terminal which receives the requested music piece template data file and creates data of a new piece of music based on the received music piece template data file.

According to the present invention, the object is still further accomplished by providing a method for assisting in composing music comprising: a step of connecting to a music piece template data providing apparatus which stores a plurality of music piece template data files respectively representing features of source music pieces; a step of receiving, through selective request, a desired music piece template data file from the connected music piece template data providing apparatus; a step of creating data of a new piece of music based on the received music piece template data file; and a step of storing the created data of a new piece of music.

According to the present invention, the object is still further accomplished by providing a storage medium storing a program that is executable by a computer for assisting in composing music, the program comprising: a module for connecting to a music piece template data providing apparatus which stores a plurality of music piece template data files respectively representing features of source music pieces; a module for receiving, through selective request, a desired music piece template data file from the connected music piece template data providing apparatus; a module for creating data of a new piece of music based on the received music piece template data file; and a module for storing the created data of a new piece of music.

According to the present invention, therefore, a new music piece will be composed having resemblance to an existing music number to some extent.

BRIEF DESCRIPTION OF THE DRAWINGS

For a better understanding of the present invention, and to show how the same may be practiced and will work, reference will now be made, by way of example, to the accompanying drawings, in which:

FIG. 7 is a flowchart showing an operation of automatic music performance in an embodiment of the present invention;

FIGS. 8*a* and 8*b* are, in combination, a flowchart showing a process of extracting music piece data at the side of a terminal apparatus in an embodiment of the present invention.

DESCRIPTION OF THE PREFERRED EMBODIMENTS

Figure 1:
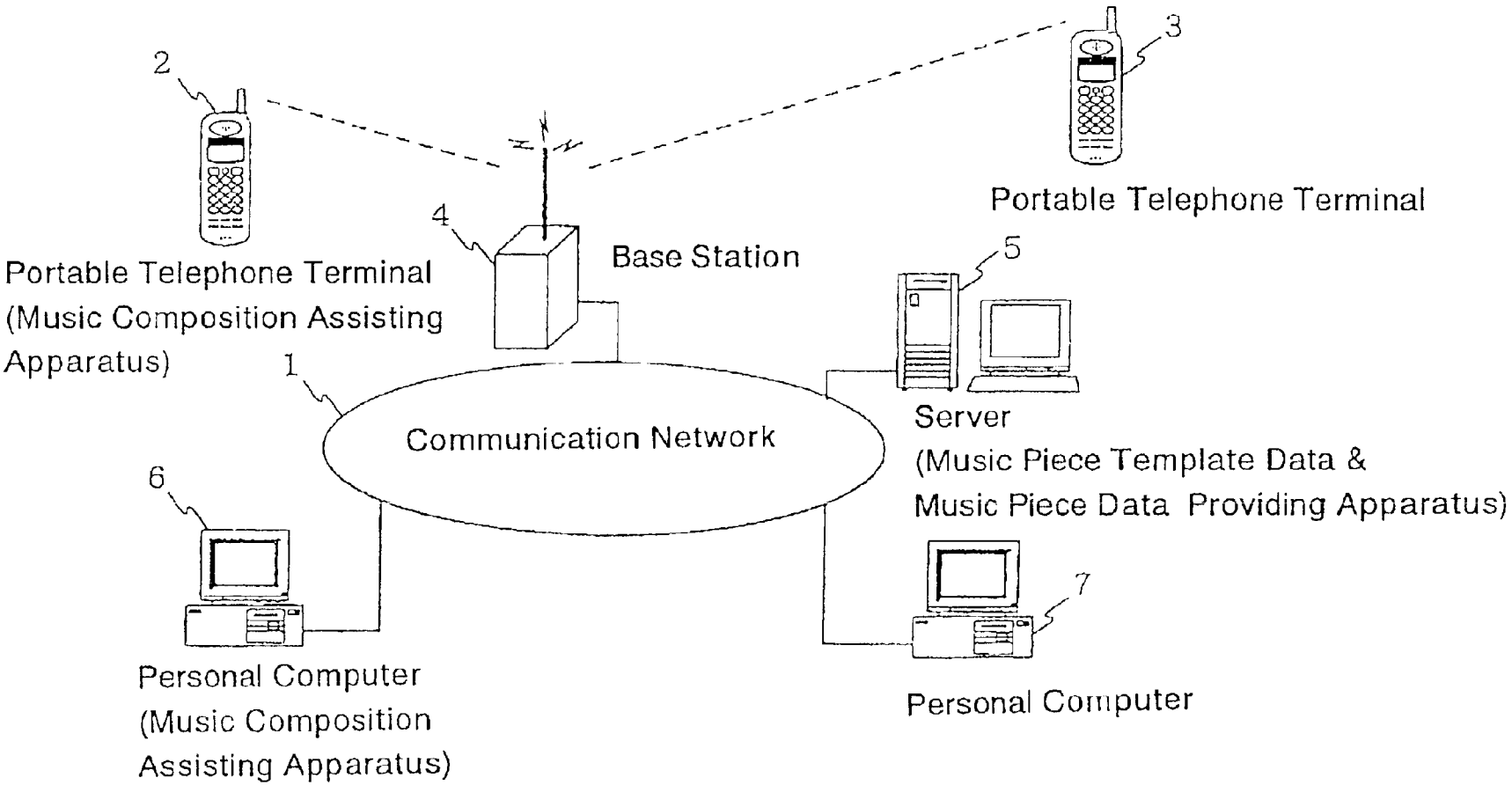
FIG. 1 is a schematic diagram illustrating a general system of an embodiment according to the present invention.

FIG. 1 illustrates a schematic diagram of a general system of an embodiment according to the present invention for assisting a user in composing a music piece by data processing. The reference numeral "1" denotes a communication network including fixed subscriber telephone lines, portable subscriber telephone lines, leased lines, etc. connected with each other. Portable telephone (cellular phone) terminal units 2 and 3 are connected wirelessly with each other via a base station 4 (or base stations 4), which in turn is connected to the communication network 1, wherein the portable telephone terminal unit 2 is equipped with a music composition assisting apparatus. A server 5 is connected to the communication network 1 and functions to supply or deliver music piece template data and music piece data. Personal computers 6 and 7 are also connected to the communication network 1, wherein the personal computer 6 is equipped with a music composition assisting apparatus. The communication network 1 may be a LAN (local area network) connecting the server 5 and the personal computers 6 and 7 therein.

In the system of this embodiment, the server 5 stores music piece template data files which are prepared by an operator listening to original existing music pieces, analyzing the same and categorizing the musical characteristics (characters and features) and/or by extracting the musical characteristics from original existing music pieces by means of a computer or by a human. The portable telephone terminal unit 2 and the personal computer 6 can selectively download desired one or ones of a number of music piece template data files stored in the server 5, and can create a data file of a new piece of music which is different from the original existing music piece, so that the user can enjoy playing back or performing the newly created music piece.

Figure 2:
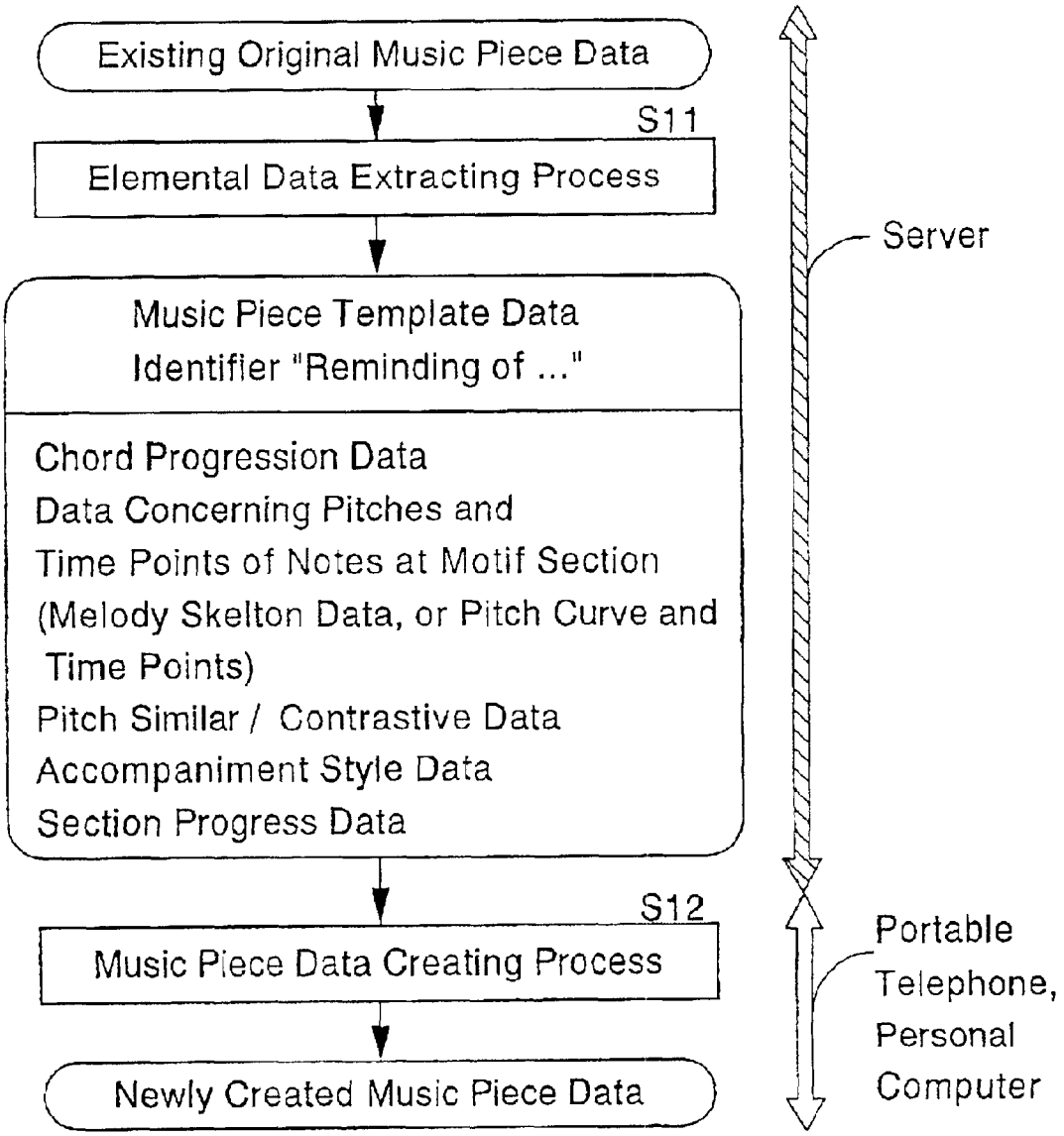
FIG. 2 is a chart showing the process of composing music piece data from original existing music piece data in an embodiment of the present invention.

FIG. 2 is a chart illustrating the process of composing a data file of a new piece of music from a data file of an original piece of existing music in an embodiment of the present invention. Starting with a data file of an original piece of existing music containing a plurality of performance parts, a step S11 analyzes each of the performance parts of the original existing music piece, and extracts characteristics of the original music piece to create music piece template data files containing elemental data representing such characteristics. The music piece template data file is given an identifier name "Reminding of so and so" using the title (or other feature) of the source music piece. The contents of the music piece template data file include chord progression data for an entire piece of music or at least for several measures, data concerning pitches and time points of notes for several measures which constitute a melody motif, pitch similar/contrastive data (pitch resemblance data), accompaniment style data of the music piece, and so forth, or at least one of these.

The chord progression data is a data stream representing a pattern of chord variation along with the music progression, and will be obtained, for example, by analyzing the chord part of the source music piece. Where the same chord sequence is repeated periodically, the minimal length of chord sequence will suffice. For the data concerning the pitches and the time points of the notes at the motif section, data of the melody skeleton or data of the pitch curve and the time points of the notes at the motif section are extracted. The melody skeleton data is a data stream representing the pitches and the time points of notes of primary importance in the melody part of the source music piece, for example the first notes and the notes at the strong beats in the respective measures. Alternatively, a pitch curve (a curve representing a variation pattern of the pitches with respect to time) and time points of the motif section will be used in place of the melody skeleton. The melody skeleton data, or the pitch curve and time points will be obtained by analyzing a melody fraction in length of several measures, for example, two measures which are selected to be a motif beforehand. For example, in the melody part of the source music piece, the climactic portion (i.e. bridge portion) which has a louder volume or other louder portion will be selected as a motif section automatically according to the software employed. Or the user may designate a motif portion by using a switch or other controls manually while listening to the source music piece, i.e. an original existing piece of music.

The pitch similar/contrastive data is data indicating resemblance of particular spans of, for example, two-measure length in terms of melody skeleton as compared with the motif portion (e.g. of two measures). Where particular two measures are indicated to be "pitch-similar", it means that the melody skeleton of those two measures is similar or identical to the melody skeleton of the motif section. Where a certain two-measure span is indicated to be "pitch-contrastive", it means that the melody skeleton of such a span is contrastive to the melody skeleton of the inputted motif. The pitch similar/contrastive data are extracted by analyzing the pitch curve of the melody part. Further, the chord progression data extracted from the chord part may also be referenced in determining similarity or contrastiveness. In addition, rhythm similar/contrastive data may be extracted from the melody part of the source music piece data file, wherein the rhythm similar/contrastive data is data indicating resemblance of particular spans of, for example, two-measure length in terms of rhythm as compared with the motif portion (e.g. of two measures). Where particular two measures are indicated to be "rhythm-similar", it means that the rhythm pattern (i.e. note existing time points) of those two measures is similar or identical to the rhythm pattern of the motif section. Where a certain two-measure span is indicated to be "rhythm-contrastive", it means that the rhythm pattern of such a span is contrastive to the rhythm pattern of the inputted motif.

The accompaniment style data indicate accompaniment styles of the respective sections of the music piece, for example, an introduction A section, an introduction B section, a main A section, a main B section, a fill-in section, an interlude section and an ending section. Examples of accompaniment style are 8-beat (8th note rock feel), 16-beat (16th note rock feel), etc. The accompaniment styles can be extracted from the source music piece by analyzing its one or more accompaniment parts, such as a rhythm part, a base part, a backing part. Also the section progression data will be extracted to define how those sections progress.

The original music piece data file, i.e. the source music piece data file has only to be the MIDI format. If the music piece data file is waveform data in the WAVE format or compressed waveform data in the MP3 format, the data may be converted into the MIDI format using some proper conversion software so that a music piece template data file can be created at least with respect to the melody as in the case of the MIDI format.

Then based on the music piece template data, a step S12 creates a new music piece data and store the same in the storage device. Thus the newly created music piece resembles the source music piece to a certain degree and has similar bridge portions and features. The user can therefore compose a new music piece to his/her preference by selecting desired music piece templates and/or an existing source music piece. A created music piece would generally be of a simpler structure than the original existing music piece. By applying a simple edition to the created music piece, the user can further add his/her tastes to the created music piece. If some points or features are missing in the analyzed template data, the user can easily compensate such, points and features through an editing operation. Among the above extracted data, the chord progression data, the data concerning pitches and time points of the notes at the motif section, and the accompaniment style data. If the newly created music piece data may not include a chord part, the extraction of the chord progression data may not be necessary. Further, if the newly created music piece may not contain an accompaniment part, the extraction of the accompaniment styles will not be necessary.

Now back again to FIG. 1, the system includes a configuration for paying a copyright royalty due for downloading a music piece template data file which is created on the basis of an existing music piece or is automatically extracted from an existing music piece. A music piece template data file and its source music piece data file may be served in a set for downloading purpose. The template data and the source music piece data may be in different file formats, or may be formed in a single integrated data file. The music piece template data file contains information on the title of the source music piece, the names of the composer, the poet or the singer, or else. Such information will help the user in selecting a desired one from among a plurality of template files stored in the server 5. The template files maybe prepared selectable by designating the names of the source music.

The portable telephone terminal 2 and/or the personal computer 6 may include a music piece template data creating device which creates music piece template data by extracting elemental musical features of a source music piece, so that the terminal apparatuses 2 and/or 6 have only to download an original existing music piece data file or source music piece data file from the server apparatus 5 or to install such a source music piece data file beforehand, and then to create a music piece template data file based on such a source music piece data file. The user can compose a new music piece based on the created template data file. The user may play back the composed music piece data file and enjoy listening to the composed music piece, or may utilize the composed music piece data for sounding the telephone ring (call receipt alarm). The user can send the newly composed music piece data file to another portable telephone terminal 3 or another personal computer 7 as an attachment to an e-mail to present the composed music piece to friends or other acquaintances. The music piece template data file may also be delivered to other subscribers on the communication network. The user terminal 2 or 6 may send back the created music piece data file to the server 5 to enhance the database of the musical template files in the server 5.

There can be several arrangements or configurations of the system according to the present invention depending upon where to conduct the elemental data extracting process of S11 and the music data creating process of S12. A first embodiment will be that the server 5 stores the original existing music piece data files (source music piece data files), extracts elemental feature data to create music piece template data files, and stores the created template data files, while the portable telephone terminal 2 or the personal computer 6 conducts the music composition assisting process including the music piece data creating process of S12 and stores the newly composed music piece data file as shown by the ranges indicated by double-head arrows in FIG. 2.

A second embodiment will be that the server 5 stores the source music piece data files, while the portable telephone terminal 2 or the personal computer 6 conducts the processing from the elemental data extraction of S11 forward. A third embodiment will be that the portable telephone terminal 2 or the personal computer 6 stores the source music piece data files in its hard disk, etc. directly from an external medium such as a CD-ROM and conducts the elemental data extracting process of S11 and other processes offline.

Whereas the above three embodiments are typical in arrangement, a fourth embodiment may be that a first server stores the source music piece data files and a second server receives music piece data files from the first server, conducts the elemental data extracting process to create template data files, and stores the created template data files to prepare for an access from a client. A fifth embodiment may be that the portable telephone terminal 2 or the personal computer 6 commands the server 5 to conduct all the processing from the elemental data extracting process of S11 up to the music piece data creating process of S12, and then simply downloads the newly created music piece data file from the server 5. In this last case, there will be no substantial burden at the side of the portable telephone terminal 2 or the personal computer 6. While the above described process of elemental data extraction at S11 takes place automatically according to the installed software, an operator may listen to the played-back music piece data file, and analyze the music piece to extract the elemental features of the music, thereby creating a template data file.

Figure 3A:
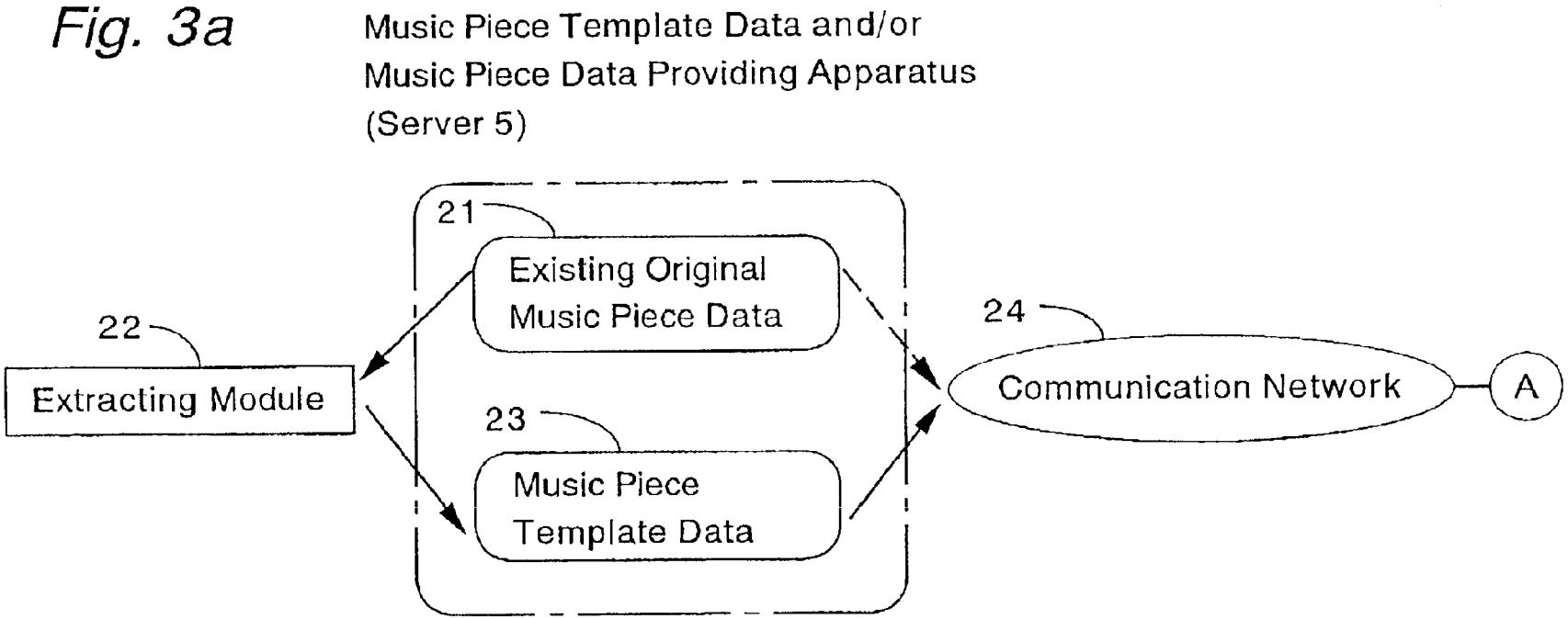
FIGS. 3*a* and 3*b* are, in combination, a chart showing data transmission paths in an embodiment of an assisting system for composing music according to the present invention.
Figure 3B:
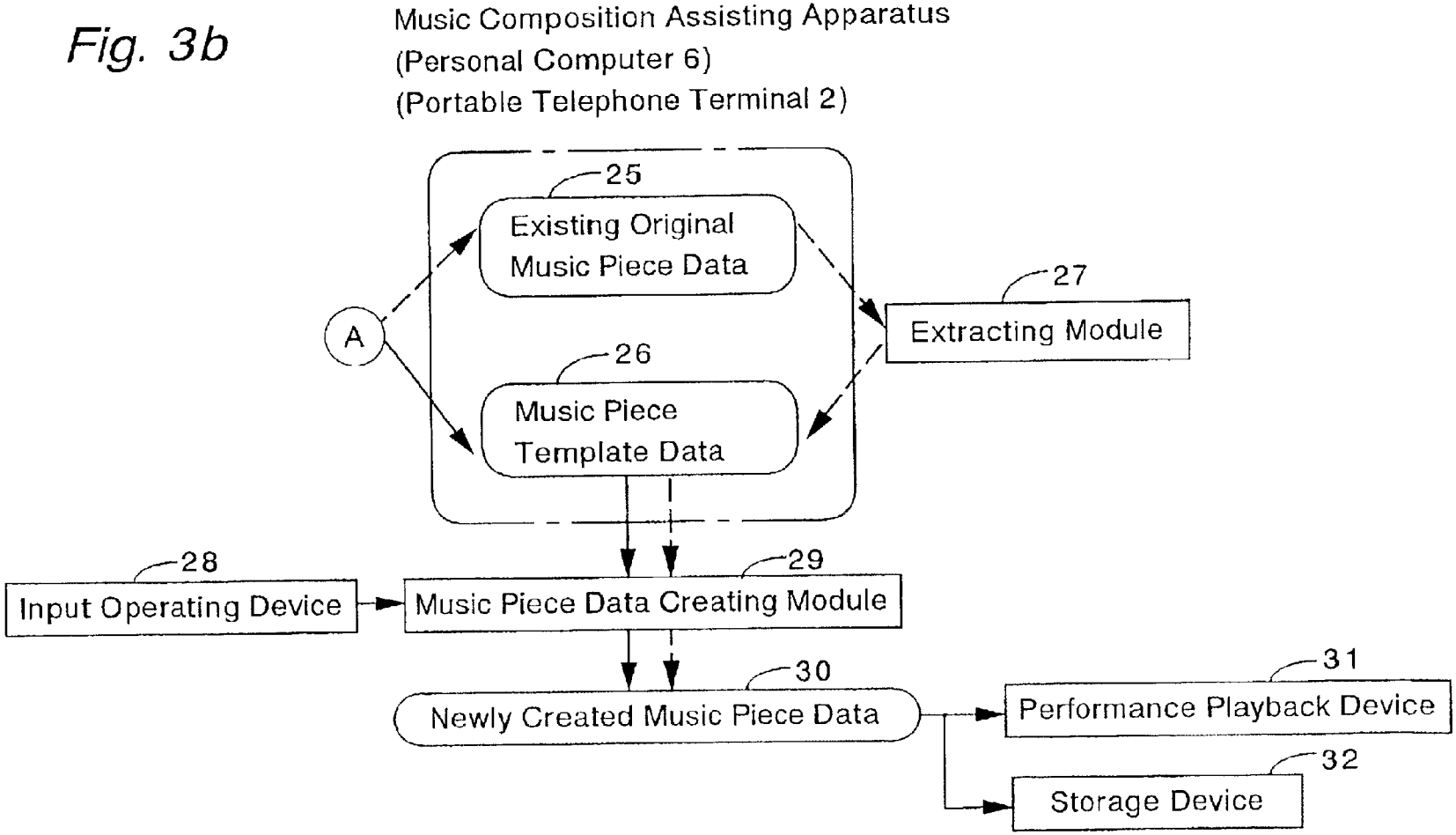

FIGS. 3*a* and 3*b* show, in combination, the data transmission paths in the system described above, illustrating how an original existing music piece data file (source music piece) is transmitted and how a music piece template data file extracted from the source music piece is transmitted from the server 5 to the client 2 or 6. In FIGS. 3*a* and 3*b*, the paths depicted in thick solid arrows correspond to the system configuration of the above enumerated first embodiment. The server 5, i.e. the data providing apparatus, stores the original existing music piece data files, i.e. data files of source music pieces 21, extracts elemental musical features from the source music pieces 21 to create musical piece template data files, and stores the created template data files 23. Upon request, a musical template data file 23 is delivered to a client 2 or 6, i.e. the music composition assisting apparatus, via the communication network 24. A the portable telephone terminal 2 or the personal computer 6, the client, the user operates an input device 28 to designate assistance in composing music or edition of data, and a music piece data creating module 29 creates a new music piece data file 30 based on the template data file 26. The newly created music piece data file 30 is supplied to a performance playback device 31 to play back the music piece, and is stored in a storage device 32 on the other hand.

In FIGS. 3*a* and 3*b*, the paths depicted in thick broken arrows correspond to the system configuration of the above enumerated second embodiment. The server 5 stores data files of source music pieces 21 and delivers, upon request, a source music piece data file 21 to the music composition assisting apparatus 2 or 6 via the communication network 24. The music composition assisting apparatus 2 or 6 stores the received source music piece data file 25, and extracts therefrom a music piece template data file 26 by means of an extracting module 27. Then the music piece data creating module 29 creates a new music piece data file 30 based on the template data file 26, similarly as described above.

According to the system configuration of the third embodiment mentioned in reference to FIG. 2 above, the music composition assisting apparatus (the portable telephone terminal 2 or the personal computer 6) stores source music piece data files directly installed from a CD-ROM or else to the hard disk, etc. and extracts a music piece template data file from a source music piece data file by the processing at the extracting module 27. According to the system configuration of the fourth embodiment mentioned in reference to FIG. 2 above, the source music piece data files 21 and the music piece template data files 23 are provided in separate servers. Further, according to the system configuration of the fifth embodiment mentioned in reference to FIG. 2 above, the music piece data creating module 29 is included in the server side 5.

A source music data file 21 and a corresponding music piece template data file 23 may be handled and transmitted in a pair through the communication network 24. Such data files may be consolidated and integrated into a single file to be stored in the music composition assisting apparatus. Further, a newly created music piece data file may also be integrated therein. For example, in the case of a music piece data file of the SMF (standard MIDI file) format, the music piece template data may be described in the text format and may be inserted into the setup measure portion as a meta-event which is distinguishable from the performance data. By integrating the different kinds of data into a single data file, the file can be handled easily for storage, supply, delivery and so forth keeping the interrelation of the data, and it will also be convenient for the copyright administration.

Figure 4:
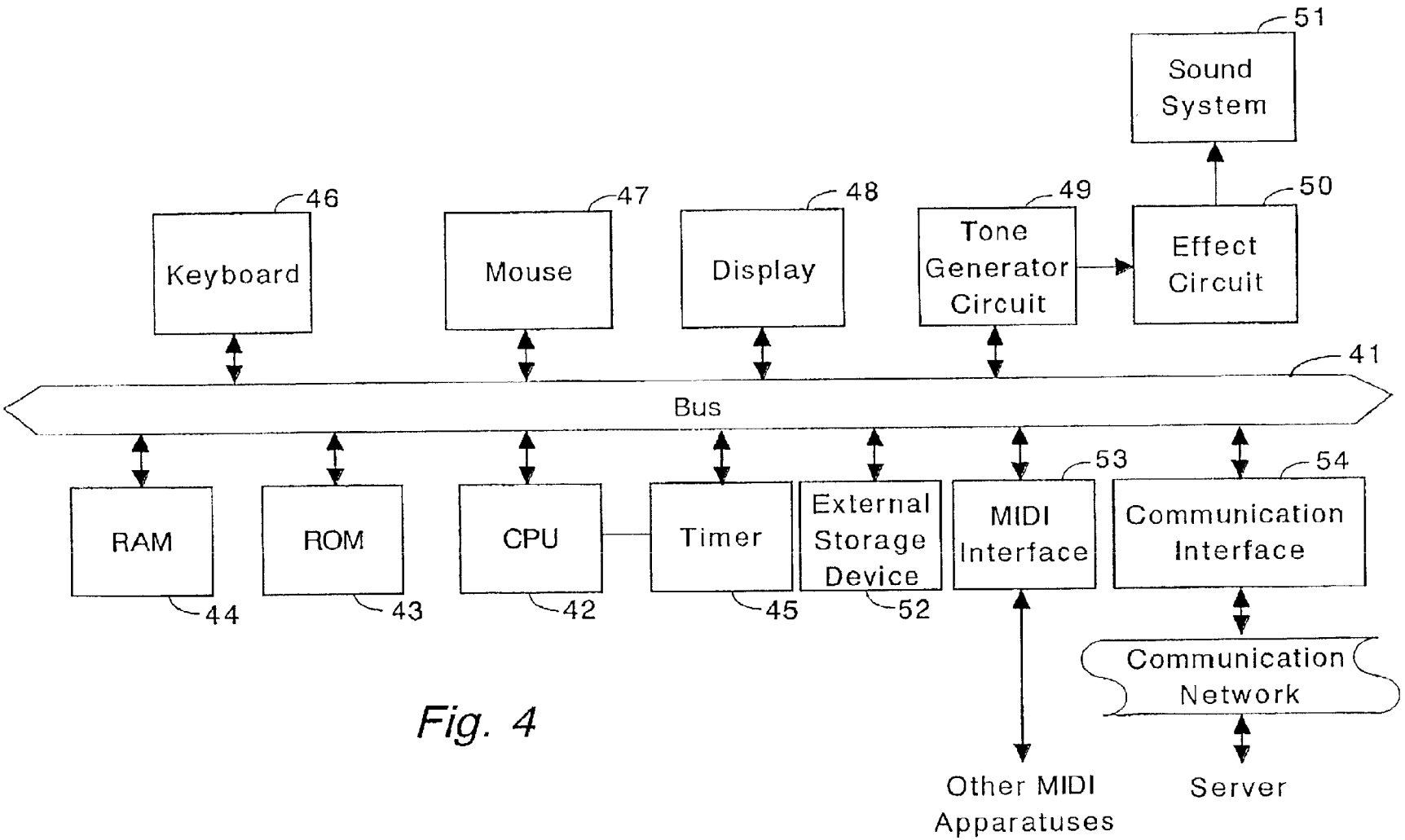
FIG. 4 is a block diagram showing the hardware structure of a system assisting in composing music as an embodiment of the present invention, being configured by a personal computer.

FIG. 4 depicts a block diagram of the hardware structure of a personal computer serving as a music composition assisting apparatus as an embodiment of the present invention. Connected to a bus 41, the personal computer comprises a CPU 42, a ROM 43, a RAM 44 and a timer 45. The timer 45 counts time and generates timing signals for timer interruption process for the programs, and other time progression process. Also connected to the bus 41 are a keyboard 46, a mouse 47 and a display 48, as in a conventional personal computer. A tone generator circuit 49, an effect circuit 50 and a sound system 51 are provided to generate and produce musical tones from the performance data. The tone generator circuit 49, the effect circuit 50 and the amplifier circuit in the sound system 51 may be contained in a sound card. The sound card may further contain a ROM which stores PCM waveform data among the data in the ROM 43. The tone generator circuit 49 includes necessary D/A converters.

An external storage device 52 may be a hard disk drive (HDD), a flexible magnetic disk drive (FDD), a CD-ROM drive, a magneto-optical disk (MO) drive, a digital versatile disk (DVD) drive, etc. A MIDI interface 53 is to connect the music composition assisting apparatus to other MIDI apparatuses such as an electronic musical instrument and a MIDI keyboard for inputting music performance data in a MIDI format. The MIDI interface 53 is also for outputting the created music piece data to external MIDI apparatuses in a MIDI format to play back the music piece. A communication interface 54 is to connect the music composition assisting apparatus to servers and other personal computers or to portable telephone terminals on Internet via a subscribers telephone network or an ISDN, and also to server computers and other personal computers via a LAN, etc.

The CPU 42 loads the basic input/output system (BIOS) program stored in the ROM 43 and the operating system (OS) program installed in the hard disk drive (HDD) of the external storage device 52 into the RAM 44 to conduct regular general input/output controls. Such controls include, for example, inputting information according to the manipulation of the keyboard 46 or of the mouse 47, conducting the input/output controls of information via the MIDI interface 54 or the communication interface 54, and controlling the exhibit on the display screen 48. The CPU also loads the music composition assisting program installed in the hard disk into the RAM 44 to conduct the music piece data file creation processing and, in an applicable case, the music piece template data extraction processing. The hard disk is used as a database storage, storing a plurality of music piece data files and a plurality of music piece template data files. The newly created music piece data files are also stored in the hard disk.

The above-mentioned music composition assisting program and the above-mentioned music piece data files and music piece template data files may be stored in a CD-ROM, which is to be mounted in the external storage device 52 for installing such a program and data files into a hard disk which is a storage medium in the external storage device 52, too. The above program and data files may be downloaded via the communication interface 54 to the hard disk from a server computer connected in the communication network. The newly created music piece data file as assisted by the invention apparatus may be transmitted to other personal computers or portable telephone terminals via the communication network as an attachment to an e-mail.

The tone generator circuit 49 generates tone signals in accordance with the performance control information supplied to the tone generator circuit 49 via the bus 41. The generated digital tone signals are converted into analog tone signals, and then are imparted with various sound effects such as a reverberation effect by the effect circuit 50, and are finally emitted into the air as audible sounds by the sound system 51 including an amplifier, a loudspeaker, etc. Even in the case where no tone generator circuit is provided, the same function can be performed by a personal computer incorporating an A/D converter and installing a CODEC driver under the operation of the CPU 42 and the OS software.

While the above descriptions have been made in connection with the music composition assisting apparatus configured on a personal computer, the invention can also be practiced using a dedicated electronic musical instrument.

Figure 5:
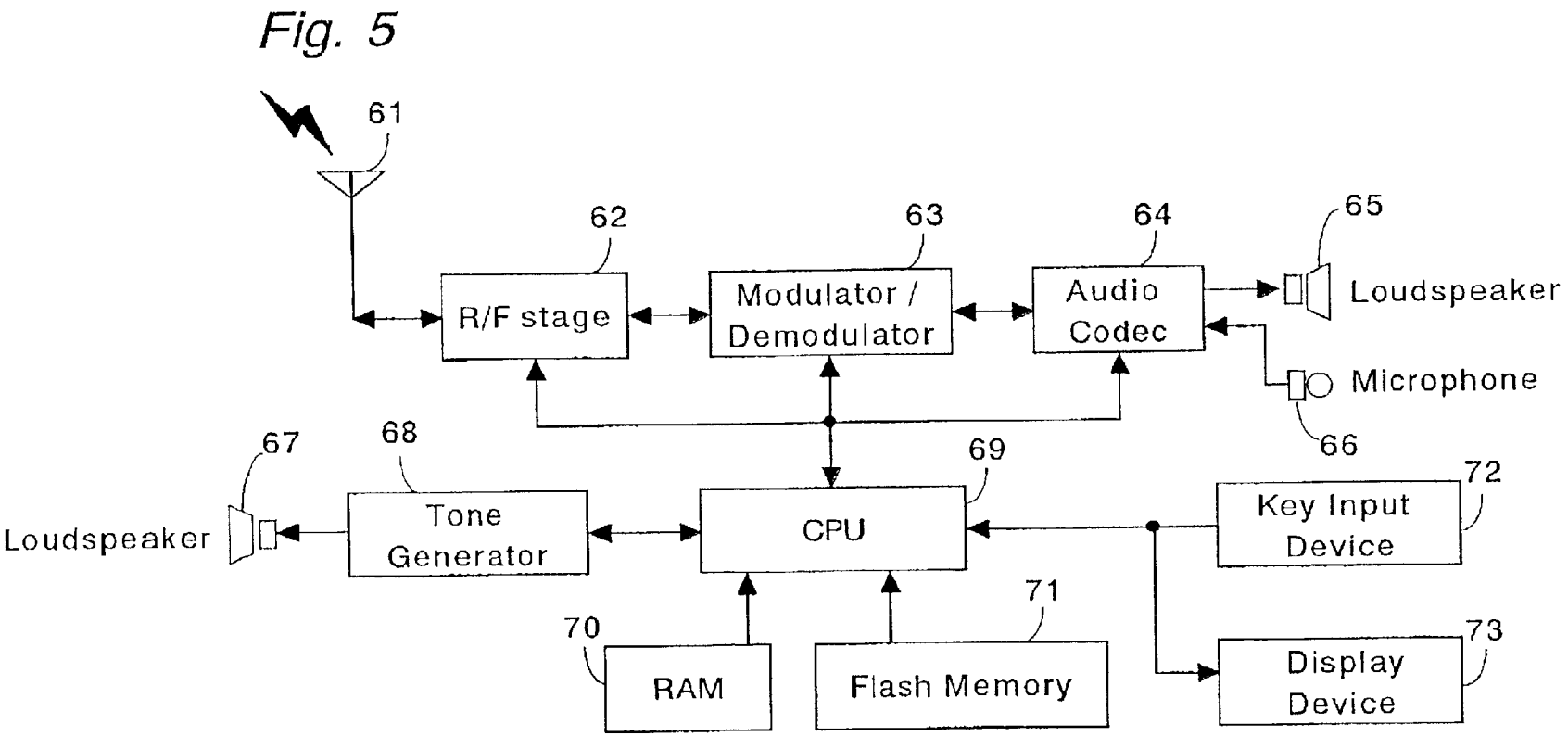
FIG. 5 is a block diagram showing the hardware structure of a system assisting in composing music as an embodiment of the present invention, being configured by a portable telephone terminal.

FIG. 5 depicts a block diagram of the hardware structure of a portable telephone terminal serving as a music composition assisting apparatus as an embodiment of the present invention. An explanation will be made with respect to an example in which a newly created music piece is used for a telephone ringing (call receipt alarm melody). The configuration would basically be such that a function of a portable telephone unit is incorporated into the structure of FIG. 4. For the sake of simplicity, an example configured with a dedicated CPU chip and peripheral circuits connected thereto.

In FIG. 5, an antenna 61 receives and transmits radio waves on the communication network. An R/F stage 62 is to amplify the levels of the R/F signals and/or to covert the frequencies of the R/F signals in receiving radio frequency signals from the base station and in transmitting radio frequency signals to the base station. A modulator/demodulator 63 modulates the carrier radio wave with audio (voice) signals or data signals to be transmitted, and demodulates the received radio wave to get the audio signals or the data signals. An audio (voice) codec 64 converts the demodulated digital audio signals into analog signals to output to a loudspeaker (earphone) 65 and converts the analog audio signals inputted from a microphone 66 into digital signals to output to the modulator/demodulator 63. A loudspeaker 67 is to sound out a telephone ringing melody, an alarm melody and background music. It emits musical sounds of the tone signals generated at the tone generator circuit 68 in accordance with the performance data, thereby performing the respective functions. The tone generator circuit 68 contains an A/D converter.

A CPU 69 contains a timer circuit therein, and conducts general input/output controls of the entire unit using a RAM 70 as the working area based on the program stored in the flash memory 71. The CPU 69 also conducts a call setting or a call canceling on the radio telephone lines, data communication controls, etc. for a conversation with another (destination) party (not shown in the Figure). The CPU 69 operates to create a music piece data file for the telephone ringing melody. The RAM 70 is preferably backed up by a battery. In order to generate a melody for the telephone ringing based on the music piece data at the time of telephone call receipt, the CPU 69 reads out an intended music piece data file from the RAM 70 or the flash memory 71 and transmits the same to the tone generator circuit 68. The tone generator 68 synthesizes tone signals sequentially at the predetermined time points based on the performance data which represent key-on events, key-off events, pitch variation, tone color change, and so forth included in the read-out music piece data file, and outputs the same to the loudspeaker 67.

A key input device 72 contains ten-key buttons for selecting numerals for a telephone number or selecting items in the menu exhibited on the display screen, and also contains various function keys. A display device 73 includes a liquid crystal display (LCD) for exhibiting a telephone number and a set menu, and a light emitting diode for notifying the receipt of a call. The RAM 70 stores the music piece data, various input/output data such as telephone numbers, addresses, e-mail addresses and schedules, computation results and so forth temporarily. The data may be stored in the flash memory 71, instead. In order to hear the tone signals generated at the tone generator circuit 68 from the loudspeaker 65, the digital output from the tone generator circuit 68 will only have to be supplied to the audio codec 64. If the digital output signals from the tone generator circuit 68 are outputted from the digital output connector of the portable telephone unit, the tone signals can be outputted by or stored in an externally connected apparatus. Illustration of the server configuration is omitted here. Basically, it is not different from the personal computer described in reference to FIG. 4. In case the server computer need not monitor the music piece data, the tone generator circuit 49, the effect circuit 50 and the sound system 51 shown in FIG. 4 would be unnecessary.

Figure 6A:
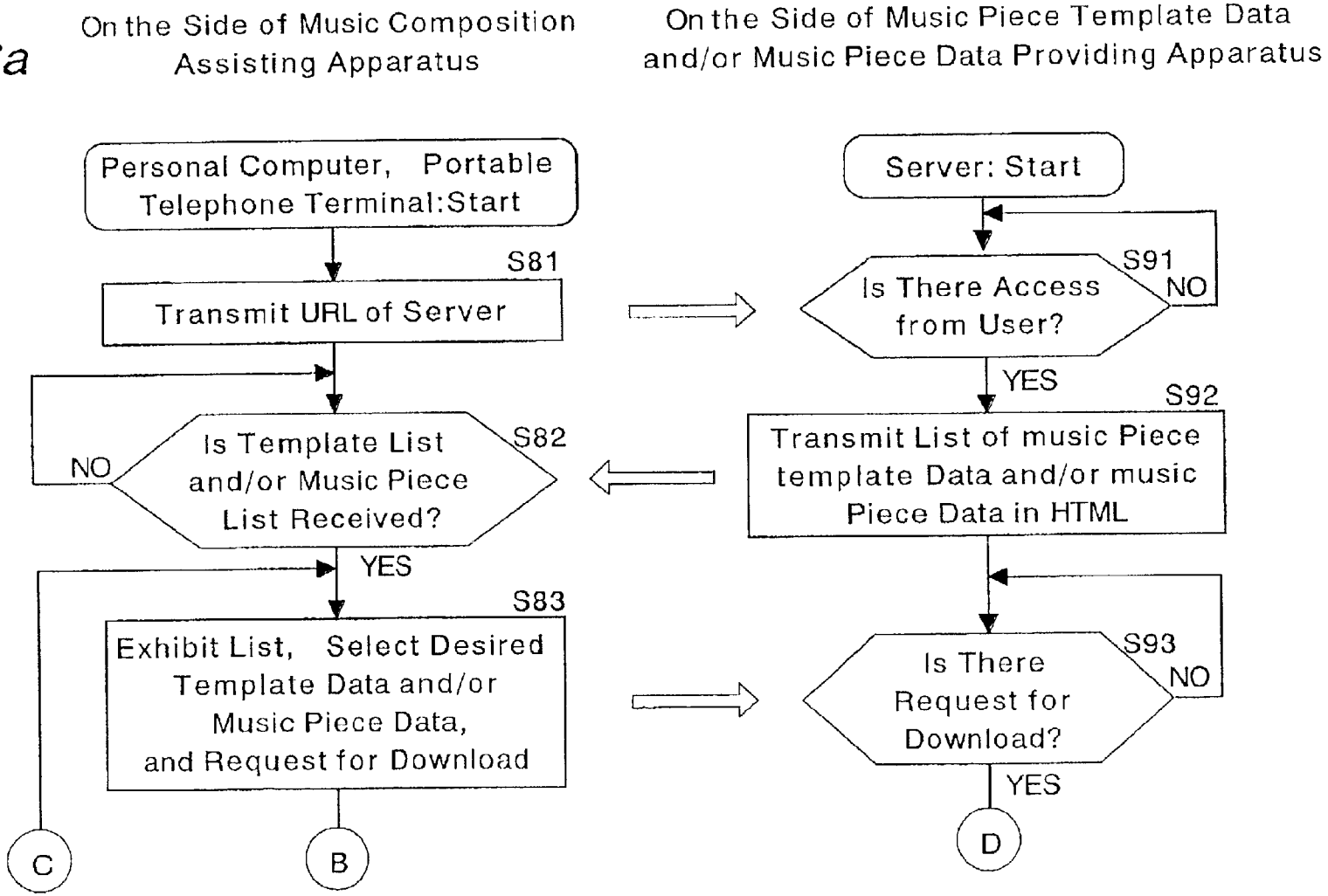
FIGS. 6*a* and 6*b* are, in combination, a flowchart showing an operation of downloading music piece template data, etc. in an embodiment of the present invention.
Figure 6B:
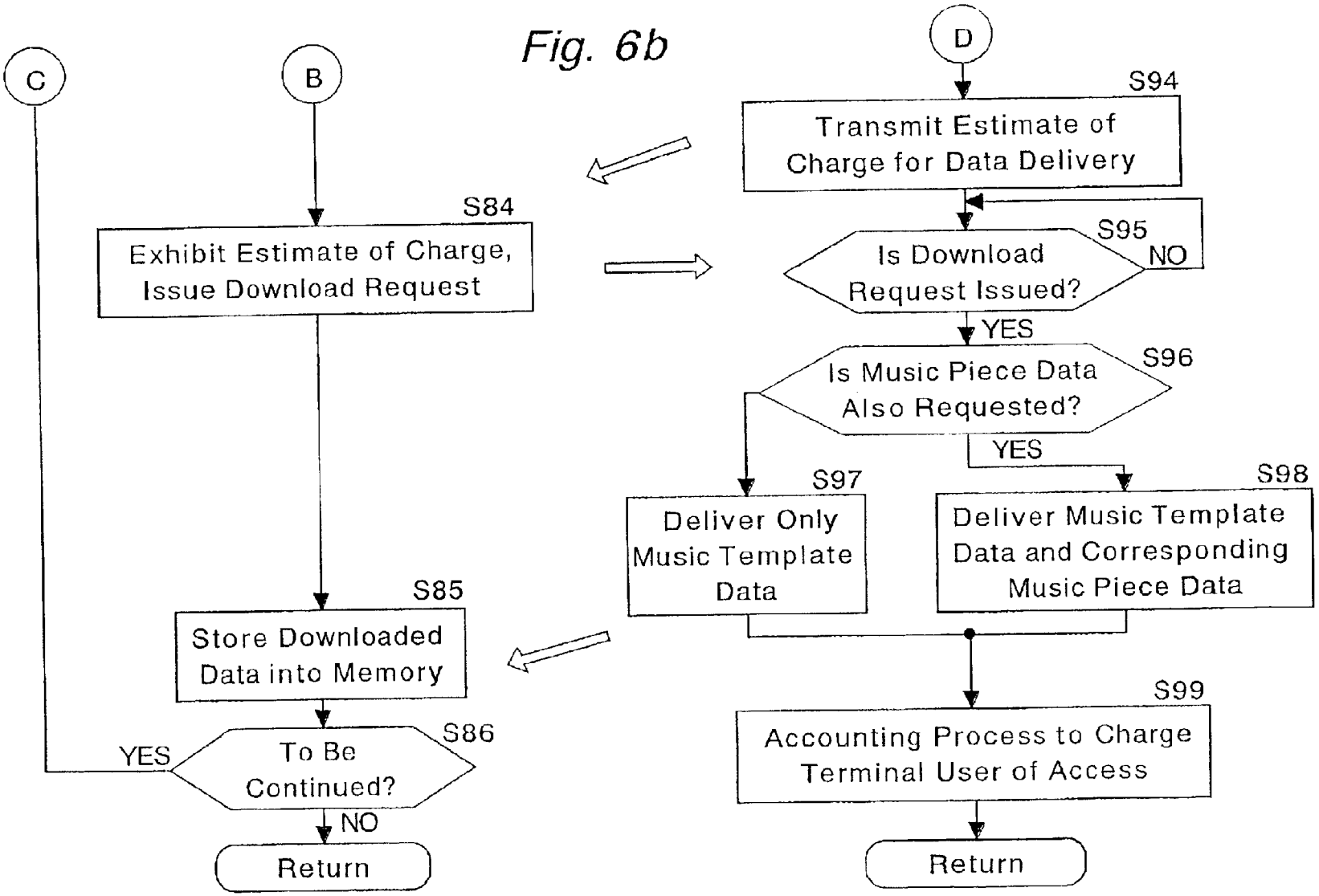

FIGS. 6*a* and 6*b* show, in combination, a flowchart of an operation of downloading music piece template data, etc. in an embodiment of the music composition assisting apparatus according to the present invention. FIGS. 6*a* and 6*b* describe the operation flow on the side of the music composition assisting apparatus, i. e. the personal computer 7 or the portable telephone terminal unit 2 (hereinafter, simply "terminal unit") and the operation flow on the side of the music piece template data and/or music piece data providing apparatus, i.e. the server 5 in parallel with indications of interrelation by hollow arrows. Let us assume that the terminal unit are in the condition of being connected to a provider through dial-up connection. The procedure on the side of the terminal unit starts by transmitting the URL (uniform resource locater) of the server at a step S81, and the process thereafter goes forward to a step S82.

On the server side, a step S91 judges whether there is an access from a user. As long as there is no access from a user, the process flow circulates to repeat the step S91. If there comes an access from a terminal unit, the process proceeds to a step S92 to transmit a list of the music piece template data files and/or the music piece data files in its possession to the terminal unit in the HTML (hypertext mark-up language) protocol, before moving forward to a step S93. Then on the terminal unit side, a step S82 judges whether a template list and/or a music piece list are received or not. As long as such a list is not received, the judgment process of S82 is repeated, and when such a list is received, the process moves forward to a step S83. The step S83 exhibits the list, and then the user selects a desired template data file and/or music piece data file manipulating the mouse or other control switches, and requests the server for downloading such a desired data file, before proceeding to a step S84 (in FIG. 6*b*). Although not shown in the FIG. 6*a* specifically, the process will be returned to the main routine (not shown, either), when the user does not make a request for downloading.

Then on the server side, a step S93 judges whether there is a request for downloading. The judgment step S93 will be repeated as long as there is no such request. When a request for downloading comes from the terminal unit, the process proceeds to a step S94 (in FIG. 6*b*) to transmit an estimate of the charge for delivery according to the music piece template data file and/or the corresponding source music piece data file which are requested for downloading. Then the process goes to a step S95. Upon receipt of the estimate delivery from the server, the step S84 on the terminal unit side exhibits the transmitted list of charges for the data delivery on the display screen. In the case the user agrees to the charges, the user issues to the server a formal request for downloading the data file. The step S95 on the server side is repeated as long as there is no formal request for down loading. Where there is such a request, the process moves to a step S96 to judge whether the corresponding source music piece data file is also requested to be delivered together with the music piece template data file. According to the judgment (Yes or No), either a step S97 delivers only the music piece template data file or a step S98 delivers the music piece template data file together with the corresponding source music piece data file.

In either case, the process proceeds to a step S99 to conduct accounting to charge the terminal user of access, and thereafter returns to the main routine. The accounting process includes a charge for the delivery of the requested data file and a copyright royalty to the composer of the original music piece. A step S85 stores the downloaded data file into the memory and goes to a step S86. The step S86 asks the user if the user wants to continue further downloading, and judges the user's intention from an input operation by the user. Where the judgment is "No", the process returns to the main routine, but where the judgment is "Yes", the process goes back to the step S83 to exhibit the list as described above, again. The list includes the music piece template data files and the source music piece data files in such a manner that a selective request maybe possible for downloading a desired file or files. According to the user's request the source music piece data file can be downloaded together with the intended music piece template data file. Each of the music piece template data files is given an identifier name containing a part or whole of the title of the source music piece data file, so that the user can easily recognize the source music pieces of the templates in the list.

Figure 10:
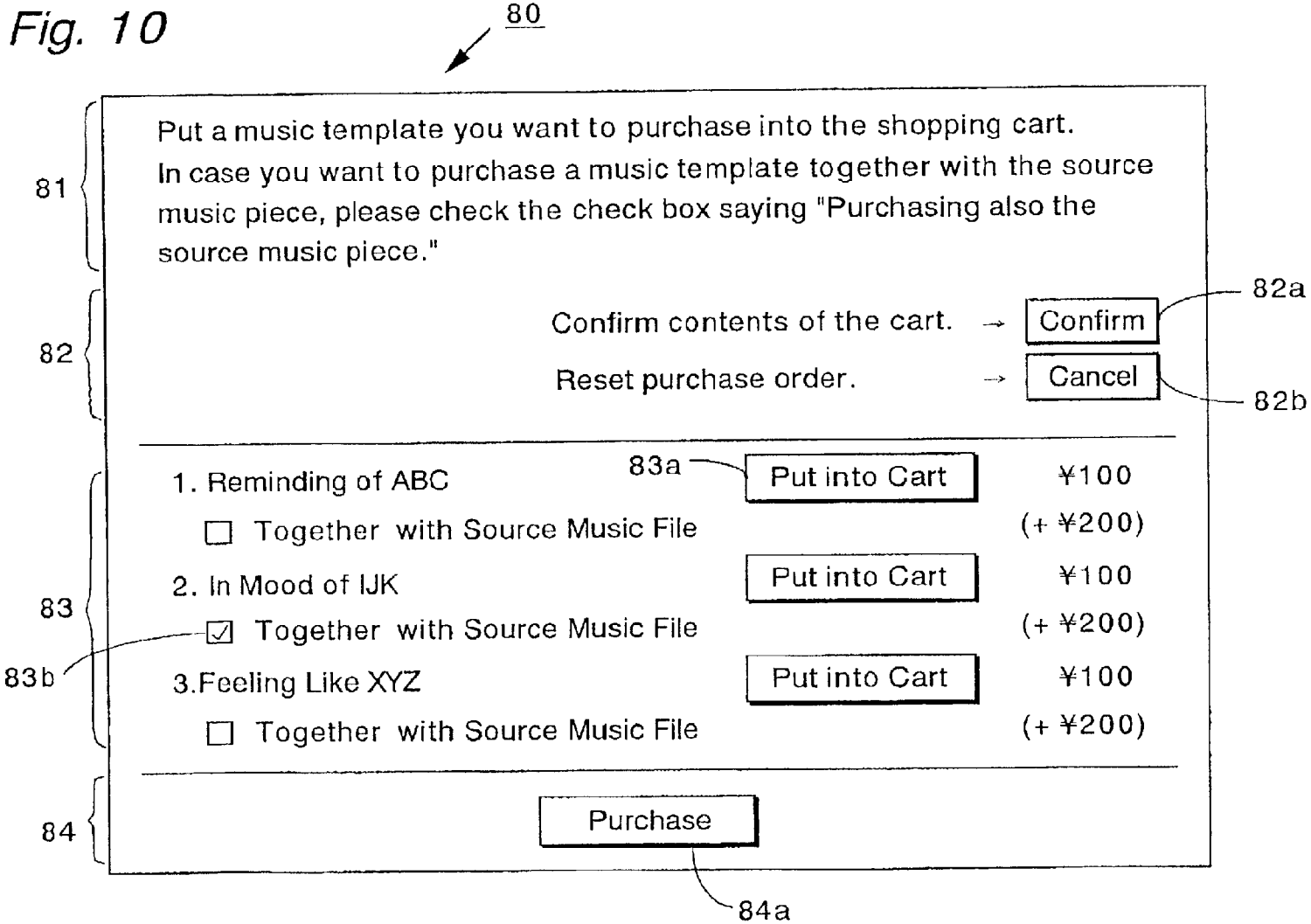
FIG. 10 is a chart showing a display window for purchasing data files through Internet.

FIG. 10 shows an example of the display window 80 exhibiting a list for purchasing data files through Internet at the step S83 at the terminal unit. In the example, the list contains names of the purchasable music piece template data files, a message of guiding the user to select a music piece template data file, information for the selection or cancellation of the goods to purchase as well as click buttons for user's commanding. In FIG. 10, an area 81 is for presenting a guidance for the user at the terminal unit to select a music piece template data file and/or the corresponding source music piece data file. In the example, the purchase of goods is operated by a shopping cart style, wherein the data concerning the item purchased by the user is added into the shopping cart upon each clicking of a "Put into Cart" button 83*a*.

An area 83 presents a list of music piece template data files and/or music piece data files to be offered to the terminal unit. The area 83 enumerates in a list form purchasable goods for the user. For each item, the identifier name and the delivery fee are indicated here. The user can confirm the exhibited information and actuate (click) the "Put into Cart" button to decide and order the purchase of the selected template data file. There is also exhibited, for each of the music piece template data files listed in the area 83, a check box as to the concurrent purchase (downloading) of the corresponding source music piece data file. The user has only to check the box to order the concurrent purchase of the music piece data file. The illustrated example of FIG. 10 shows the case in which the user commands concurrent downloading of the corresponding source music piece data file together with the purchase of the music piece template data file named "In Mood of IJK" at item "2." in the list. An area 84 depicts a "Purchase" button 84*a* for the user to finally command the purchase of the selected goods. Then the information is transmitted to the server, and the process of the step S93 forward on the server side and the process of the step S84 forward on the terminal unit side will be executed.

An area 82 is preferably prepared so that the user can confirm or cancel the purchase of goods, before finally making an order to the server. For this purpose, the area 82 contains a "Confirm" button 82*a* and a "Cancel" button 82*b*. The "Confirm" button 82*a* is for the user to click after confirming the contents of the shopping cart. In addition to such confirmation procedure, the terminal unit can exhibit the goods and the prices of the user's shopping by conducting the similar processing to the processing through the steps S83, S93, S94 and S84. The "Cancel" button 82*b* is for the user to click when the user wants to reconsider the shopping and to reset the purchasing operation and restart from the beginning of the shopping.

While, in the above example, at the time of download command in the step S83, the terminal unit sends a download request to the server, which in turn prepare an estimate list for delivery of the requested files and send the estimate list to the terminal unit, a calculation program for the fee estimation may alternatively be transmitted from the server to the terminal unit in Script language or Applet language executable at the terminal unit, so that the terminal unit can calculate the fee estimate every time the user adds a purchasing item into the cart (i.e. commands downloading a file) and exhibit such an estimate together with the list of items.

The above-described example of downloading data via a communication network is the case where the music piece template data files are stored at the server. But in the case where the terminal unit extracts template data from a source music piece data file, the terminal unit can utilize the conventional music piece data file delivery service on the communication network. But creation of a new music piece data file from a source music piece data file may raise some problem from a copyright point of view in connection with the use of the newly created music piece data file. Therefore, there had better be provided a service mode in which the server stores a number of music piece data files of which the use for extracting template data at a terminal unit is permitted under copyright, so that the terminal unit can download such a music piece data file from the server legitimately.

FIG. 7 shows a flowchart of the automatic music performance in an embodiment of the music composition assisting apparatus according to the present invention. A step S101 exhibits a list of the music piece data files stored in the apparatus. At a step S102, the user selects a desired one of the listed music piece data files. A step S103 loads a series of event data of the selected music piece data file from the hard disk onto the RAM, reads out the event data from the RAM successively according to the timing data for the music progression and send to the tone generator circuit, which in turn produces tone signals to constitute a music performance. A step S104 judges whether the operation of reading out the music piece data file is completed or not. Then not yet completed, the process of the step S103 is repeated, and when completed, the process flow returns to the main routine.

Figure 8B:
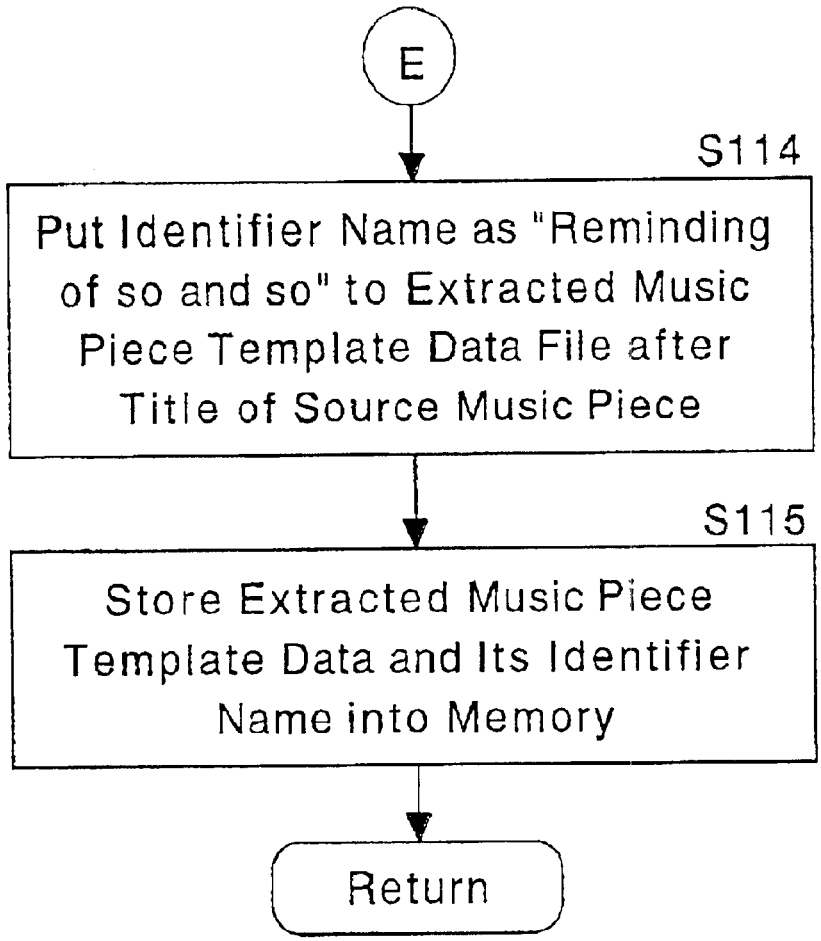

FIGS. 8*a* and 8*b* show, in combination, a flowchart of the process of extracting music piece data at the side of the terminal unit in an embodiment of the music composition assisting apparatus according to the present invention, in which the terminal unit extracts music piece template data from a source music piece data file. A step S111 exhibits a list of the names of the music piece data files stored in the terminal unit by downloading from a server or installing from a CD-ROM so that the user can select a desired one. A step S112 judges whether the user has selected a music piece from among the list. When not yet selected, the process of the step S111 is repeated, and when selected, the process flow proceeds to a step S113.

The step S113 extracts the elemental features of the selected music piece data file to create a music piece template data file. The details of the processing are as follows. From the chord part of the music piece data file, are extracted the chord progression data of the entire piece of music. From the melody part of the music piece data file, is extracted (automatically according to the program) a climactic portion of several measures, i.e. the bridge portion of the music piece, as a motif of the music piece. From this motif are extracted data concerning the time points and pitches of the notes constituting the motif, i.e. the respective time points and the general pitch curve, or a melody skeleton data string (consisting of time points and pitches of skeleton notes, i.e. notes of primary importance). Based on the aforementioned variation in the chord progression and/or the pitch comparison between the motif portion and other portions, the aforementioned pitch similar/contrastive data are extracted. From the accompaniment part (i.e. rhythm part), are extracted accompaniment style data (rhythm style data) and section progress data. Then, a step S114 (in FIG. 8*b*) put an identifier name such as "Reminding of so and so" to the extracted music piece template data file using a part of the title of the source music piece corresponding thereto. A step S115 stores the extracted music piece template data file and its identifier name in the memory, before returning to the main routine.

Figure 9A:
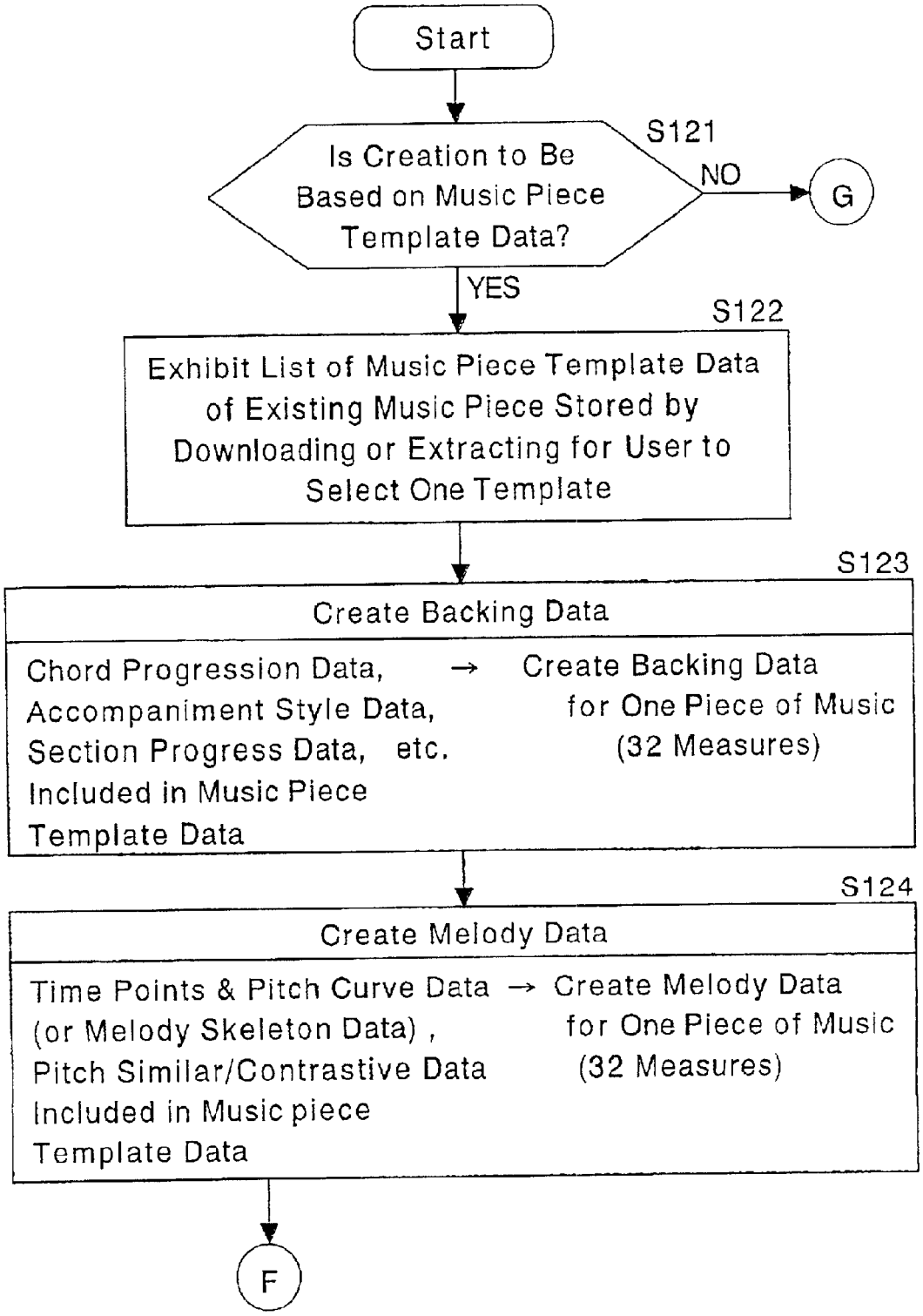
FIGS. 9*a*, 9*b* and 9*c* are, in combination, a flowchart showing a process of creating music piece data at the side of a terminal apparatus in an embodiment of the present invention.
Figure 9B:
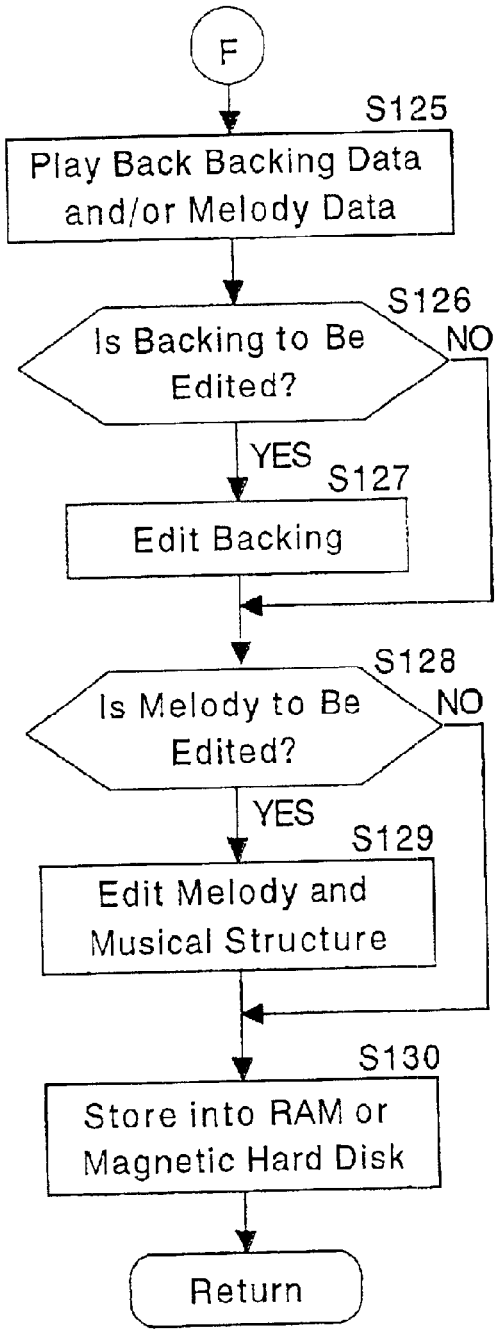
Figure 9C:
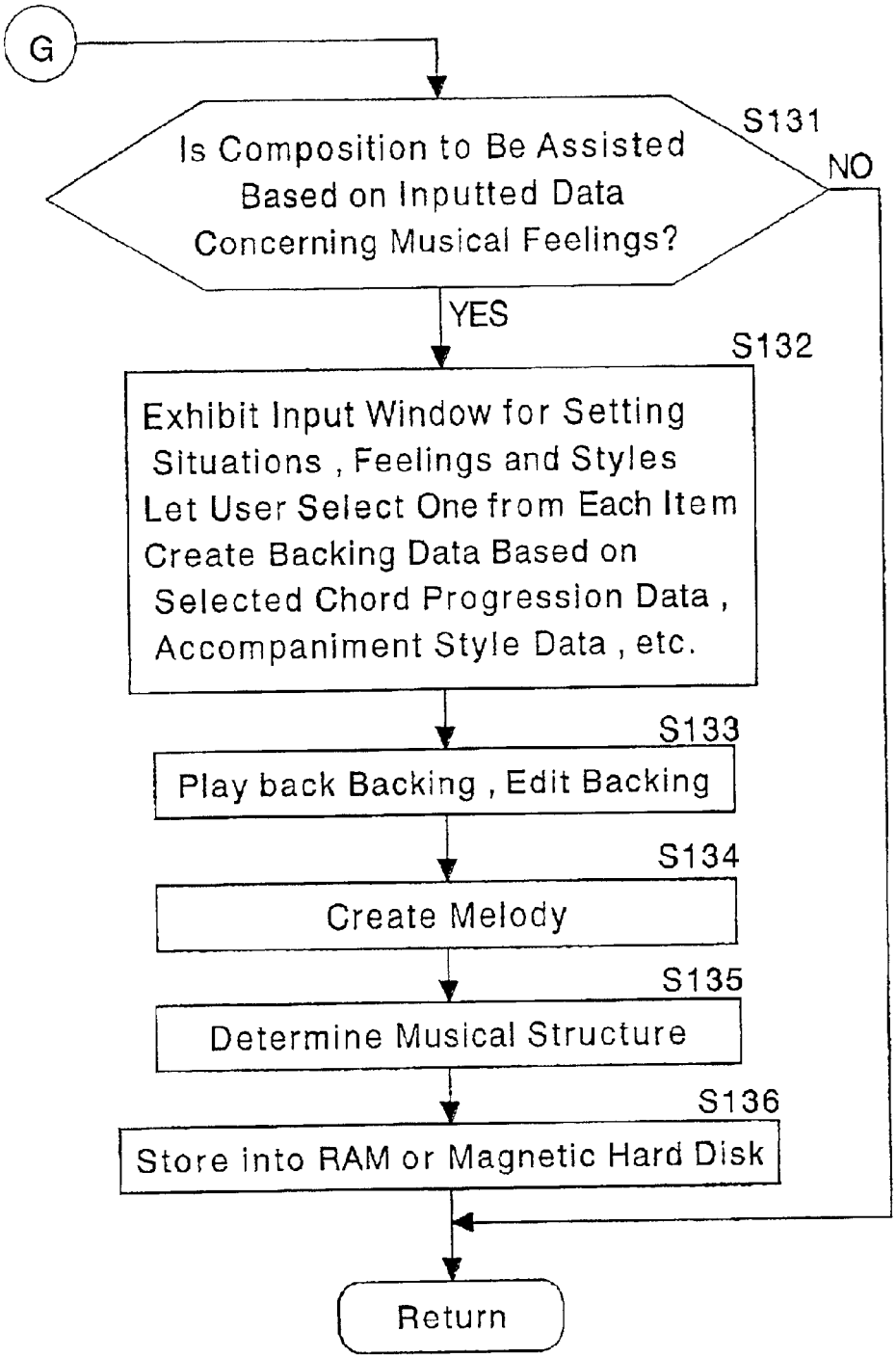

FIGS. 9*a*, 9*b* and 9*c* show, in combination, a flowchart of the process of creating music piece data at the side of the terminal unit in an embodiment of the music composition assisting apparatus according to the present invention. A step S121 judges whether the creation of a music piece data file is to be based on the music piece template data file according to the input operations of the user designation. If the judgment is affirmative (Yes), the process proceeds to a step S122, and if negative (No), the process goes to a step S131 (in FIG. 9*c*). The step S122 exhibits a list of the music piece template data files of source music pieces, which template data files are stored in the terminal unit by downloading from a server or by extracting at the side of terminal unit, so that the user can select one template from among the list. A step S123 is a step of creating a backing data file for an automatic music performance (including a chord performance, here). Namely, a backing data file for one piece of music, for example in an amount of 32 measures is created based on the chord progression data, the accompaniment style data, the section progress data, etc. included in the music piece template data file. The data for the chord performance are assigned to the chord part, and the data for the rhythm performance are assigned to the rhythm part.

A step S124 is a step to create a melody data file. Namely, a melody data file for one piece of music, for example in an amount of 32 measures, is created based on the data concerning the time points and the pitches of the notes, for example the time points and the pitch curve or the melody skeleton data, of the motif section (e.g. two measures) and on the pitch similar/contrastive data, both contained in the music piece template data file. The data for the melody performance are assigned to the melody part. A step S125 (in FIG. 9*b*) plays back the above backing data file and/or melody data file. A step S126 judges whether the backing data file is to be edited according to the input operations of the user's designation. If the edition is designated, the process goes forward to a step S127 to edit the backing data file before going to a step S128, and if the edition is not designated, the process skips to the step S128. The edition of the backing data file is a process of modifying the accompaniment style, the chord progression, etc. by manipulating the buttons and switches in accordance with the user's preference.

A step S128 judges whether the melody data file is to be edited according to the input operations of the user's designation. If the edition is designated, the process goes forward to a step S129 to edit the melody and the musical structure before going to a step S130, and if the edition is not designated, the process skips to the step S130. The edition of the melody data file is a process of modifying the time points and/or pitches of the melody notes for a length of two measures, or modifying the pitch similar/contrastive data defining the musical structure by manipulating the buttons and switches in accordance with the user's preference. The step S130 stores the created backing data file and melody data file, or the edited backing data file and melody data file into a predetermined memory area in the RAM (in the case of a portable telephone terminal), or a predetermined memory area in the hard disk (in the case of a personal computer), before returning to the main routine.

If the step S121 judges that the creation of a new music piece data file is not to be based on the music piece template data file, the process goes to a step S131 (in FIG. 9*c*). The step S131 judges whether the composition is to be assisted based on the inputted data concerning musical feelings, etc. from the user's input operations. If the judgment is affirmative (Yes), the process proceeds to a step S132, and if the judgment is negative (No), the process returns to the main routine directly. The assistance in composing music based on musical feelings, etc. is described in the aforementioned prior art publication of Japanese unexamined patent publication No. 2000-221976 and the U.S. Pat. No. 6,245,984.

The step S132 exhibits an input window for setting the situations, feelings and styles, and let the user select one from each of the items. The situations are expressed in nouns representing the situations at which the user would like to present the created new music piece, such as "birthday", "love message", "Christmas", etc. The feelings are expressed in adjectives representing the feelings to be assumed by the music piece, such as "refreshing", "tender", "lonesome", etc. The styles are expressed in adjectives representing the style possessed by the music piece, such as "urbane", "unrefined ", "tropical", etc. According to the selected word in each item (category) and based on the selected chord progression data file and accompaniment style data file, etc., the step S132 creates the backing data file.

A step S133 plays back the backing data file and edits the same. Next, at a step S134, the user inputs the time points and pitches of the notes constituting a motif section of two measures by the user's manual input operations. The time points are designated by the tapping operation of the predetermined key in the keyboard or by clicking operation of the mouse. The pitch may be designated by the mouse drawing a pitch variation curve on the screen. Thus, a melody is created based on these conditions at the step S134. A step S135 determines the musical structure as expressed by the pitch similar/contrastive data indicating the manner of the melody as compared with the motif melody, according to the user's manual designation. A step S136 stores the backing data file and the melody data file as created and edited, and the data of the musical structure into the RAM or the hard magnetic disk, before returning to the main routine.

While the above example uses a music piece template data file which is obtained by analyzing the existing source music piece, any conventional musical template data files which are created independently not based on an existing music piece may also be registered in the same database or stored in the hard disk, so that the user can also use such template data files.

As the present invention is capable of assisting in composing a music piece data file which will reflect the features of an existing source music piece, it gives an advantage over prior art technology in that the user can compose a new music piece which is somewhat similar to but somewhat different from an existing music piece of which the user is familiar. Consequently, music piece data files having features and climax which are somewhat similar to any of a number of existing music pieces. By editing the created new music piece data file, the user can obtain a music piece data file which will meet the user's taste more closely.

As will be apparent from the description herein above, some of the structural element devices of the present invention are configured by a computer system performing the assigned functions according to the associated programs. They may of course be hardware structured discrete devices. Therefore, a hardware-structured device performing a certain function and a computer-configured device performing the same function should be considered a same-named device or at least an equivalent to each other.

While particular embodiments of the invention have been described, it will, of course, be understood by those skilled in the art that the invention is not limited thereto since modifications may be made by those skilled in the art without departing from the spirit of the invention, particularly in light of the foregoing teachings. It will be understood that the embodiments shown in the draftings and described above are merely for illustrative purposes, and are not intended to limit the scope of the invention. It is therefore contemplated by the appended claims to cover any such modifications that incorporate those features of these improvements in the true spirit and scope of the invention.

What is claimed is:

1. An apparatus for assisting in composing music comprising:

a data receiving device that selectively receives, from a music piece template data providing apparatus that stores a plurality of music piece template data files, a desired music piece template data file containing data concerning am least pitches and time points of notes for at least a portion of a melody part as extracted by analyzing a portion of a melody of a source music piece;

a connecting device that connects said data receiving device to said music piece template data providing apparatus for delivering said desired music piece template data file;

a music piece data creating device that creates data of a new piece of music containing a new melody part based on said received music piece template data file; and a storing device that stores said data of a new piece of music.

2. An apparatus for assisting in composing music as claimed in claim 1, wherein said music piece template data providing apparatus is a server apparatus connected in a communication network and delivers said desired music piece template data file to said data receiving device upon request of delivery from said data receiving device, which is also connected in said communication network through said connecting device.

3. An apparatus for assisting in composing music as claimed in claim 1, wherein at least one of said music piece template data files contains chord progression data for at least several measures of music and accompaniment style data.

4. An apparatus for assisting in composing music as claimed in claim 1, further including said music piece template data providing apparatus, wherein said music piece template data providing apparatus stores said plurality of music piece template data files together with the corresponding source music piece data files for delivering said desired music piece template data file together with the corresponding source music piece data file.

5. An apparatus for assisting in composing music as claimed in claim 1, further comprising a performance playback device that reads from said storing device and plays the data of said created new piece of music.

6. An apparatus for assisting in composing music as claimed in claim 1, further comprising a data sending device for sending said music piece template data file or the data of said created new piece of music together with an electronic mail to another apparatus via said communication network.

7. An apparatus for assisting in composing music comprising:

a data receiving device that selectively receives a desired music piece data file from a music piece data providing apparatus that stores a plurality of music piece data files;

a connecting device that connects said data receiving device to said music piece data providing apparatus for delivering said desired music piece data file;

a music piece template data creating device that creates a music piece template data file containing data concerning pitches and time points of notes for at least a Portion of a melody part as extracted by analyzing a portion of a melody of a source music piece;

a music piece data creating device that creates data of a new piece of music containing a new melody part based on said music piece template data file; and a storing device that stores said created music piece template data file, or said created music piece template data file and said data of a new piece of music.

8. An apparatus for assisting in composing music as claimed in claim 7, wherein said music piece data providing apparatus is a server apparatus connected in a communication network and delivers said desired music piece data file to said data receiving device upon request of delivery from said data receiving device, which is also connected in said communication network through said connecting device.

9. An apparatus for assisting in composing music as claimed in claim 7, wherein at least one of said music piece template data files contains chord progression data for at least several measures of music, and accompaniment style data.

10. An apparatus for assisting in composing music as claimed in claim 7, further comprising a data sending device for sending said music piece template data file or the data of said created new piece of music together with an electronic mail to another apparatus via said communication network.

11. A music piece template data providing apparatus comprising:

a music piece template data storing device that stores a plurality of music piece template data files respectively representing features of source music pieces;

a data supplying device that supplies a music piece template data file containing data concerning pitches and time points of notes for at least a portion of a melody part as extracted by analyzing a portion of a melody of said source music piece; and a connecting device that connects said data supplying device to said user terminal which receives said requested music piece template data file; and a music piece data creating device that creates data of a new piece of music containing a new melody part based on said received music piece template data file.

12. A method for assisting in composing music comprising the steps of:

receiving, through a selective request, from a music piece template data providing apparatus that stores a plurality of music piece template data files, a desired music piece template data file containing data concerning at least pitches and time points of notes for at least a portion of a melody part as extracted by analyzing a portion of a melody of a source music piece;

creating data of a new piece of music containing a new melody part based on said received music piece template data file; and storing said created data of a new piece of music.

13. A storage medium storing a program that is executable by a computer for assisting in composing music, the program comprising instructions for:

receiving, through a selective request, from a music piece template data providing apparatus that stores a plurality of music piece template data files, a desired music piece template data file containing data concerning at least pitches and time points of notes for at least a portion of a melody part as extracted by analyzing a portion of a melody of a source music piece;

creating data of a new piece of music containing a new melody part based on said received music piece template data file; and storing said created data of a new piece of music.

14. A system for assisting in composing music comprising:

a server apparatus for providing music piece template data files; and a client apparatus for creating a music piece data file based on music piece template data, wherein said server apparatus includes:

a music piece template data storing device that stores a plurality of music piece template data files; and a data supplying device that supplies a music piece, template data file as selectively requested by said client apparatus from said stored plurality of music piece template data files; and wherein said client apparatus includes:

a data receiving device selectively requests and receives, from said server apparatus, a desired music piece template data file containing data concerning at least pitches and time points of notes for at least a portion of a melody part as extracted by analyzing a portion of a melody of a source music piece;

a music piece data creating device that creates data of a new piece of music containing a new melody cart based on said received music piece template data file; and a storing device that stores said data of a new piece of music.

15. A system for assisting in composing music comprising:

a server apparatus for providing music piece data files; and a client apparatus for creating a music piece template data file by extracting features from a music piece data file, wherein said server apparatus includes:

a music piece data storing device that stores a plurality of music piece data file; and a data supplying device that supplies a music piece data file as selectively requested by said client apparatus from said stored plurality of music piece data files; and wherein said client apparatus includes:

a data receiving device that selectively requests and receives a desired music piece data file from said server apparatus;

a music piece template data creating device that creates a music piece template data file containing data concerning pitches and time points of notes for at least a portion of a melody part as extracted by analyzing a portion of a melody of a source music piece from said received music piece data file;

a music piece data creating device that creates data of a new piece of music containing a new melody part based on said music piece template data files; and a storing device that stores at least either at said data of a new piece of music and said created music piece template data file.

* * * * *